United States Patent [19]

Newman et al.

[11] Patent Number: 4,887,982

[45] Date of Patent: Dec. 19, 1989

[54] GEAR DRIVEN MARINE PROPULSION SYSTEM WITH STEERABLE GEARCASE AND DUAL COUNTERROTATING PROPELLERS

[75] Inventors: Neil A. Newman, Omro; Herbert A. Bankstahl, Fond du Lac, both of Wis.

[73] Assignee: Brunswick Corporation, Skokie, Ill.

[21] Appl. No.: 253,046

[22] Filed: Oct. 4, 1988

[51] Int. Cl.[4] ..... B63H 5/10

[52] U.S. Cl. ..... 440/81; 440/53; 416/128

[58] Field of Search ..... 440/53, 58, 60, 80, 440/81, 83, 900, 79; 416/128, 129, 124, 127, 170 R

[56] References Cited

U.S. PATENT DOCUMENTS

| | | | |
|---|---|---|---|
| 2,372,247 | 3/1945 | Billing | 440/80 |
| 3,084,657 | 4/1963 | Kiekhaefer | 440/60 |
| 3,946,698 | 3/1976 | LaFollette et al. | 440/60 |
| 4,529,387 | 7/1985 | Brandt | 440/80 |
| 4,642,059 | 2/1987 | Nohara | 440/81 |

FOREIGN PATENT DOCUMENTS

| | | | |
|---|---|---|---|
| 50425 | 6/1940 | France | 416/128 |
| 357807 | 12/1937 | Italy | 416/128 |
| 0259594 | 12/1985 | Japan | 440/81 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A marine propulsion system is provided with dual counterrotating propellers, and a shaft and gear arrangement for driving the propellers. In a preferred embodiment, the marine propulsion system includes a depending gearcase having a steerable lower portion which is pivotable about a steering axis relative to an upper gearcase portion. A pair of coaxial drive shafts extend longitudinally through the gearcase, and are interconnected with the engine output shaft so as to rotate in opposite directions in response to rotation of the output shaft. The counterrotating propellers are preferably mounted to a pair of coaxial propeller shafts, and appropriate gearing is disposed between the coaxial propeller shafts and the coaxial drive shafts to drive the propeller shafts, and thereby the propellers, in opposite rotational directions. In a preferred embodiment, the gearing includes counterrotating gears fixed to the counterrotating drive shaft so as to provide cancelling gear torque loads about the steering axis. The counterrotating propellers likewise provide cancelling propeller torque loads to further accommodate steering of the steerable gearcase portion.

8 Claims, 3 Drawing Sheets

FIG. 6
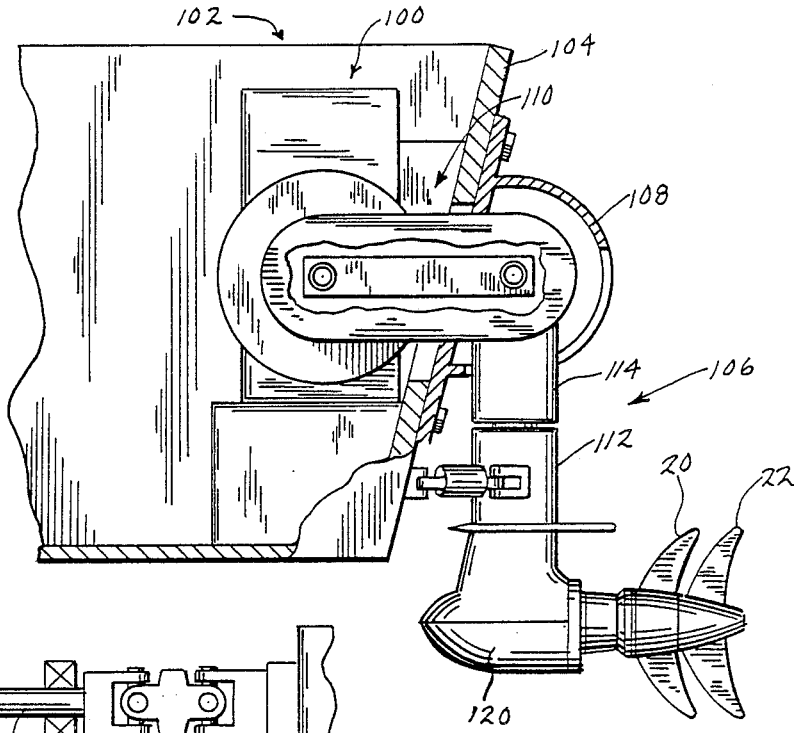
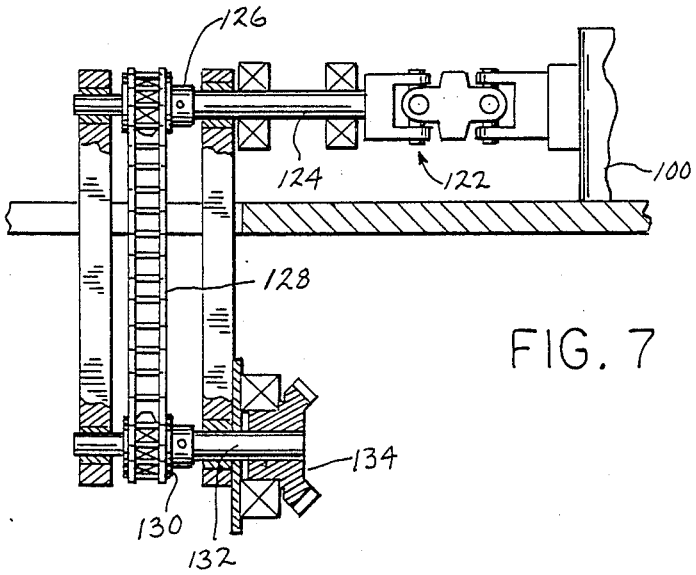
FIG. 7
FIG. 8
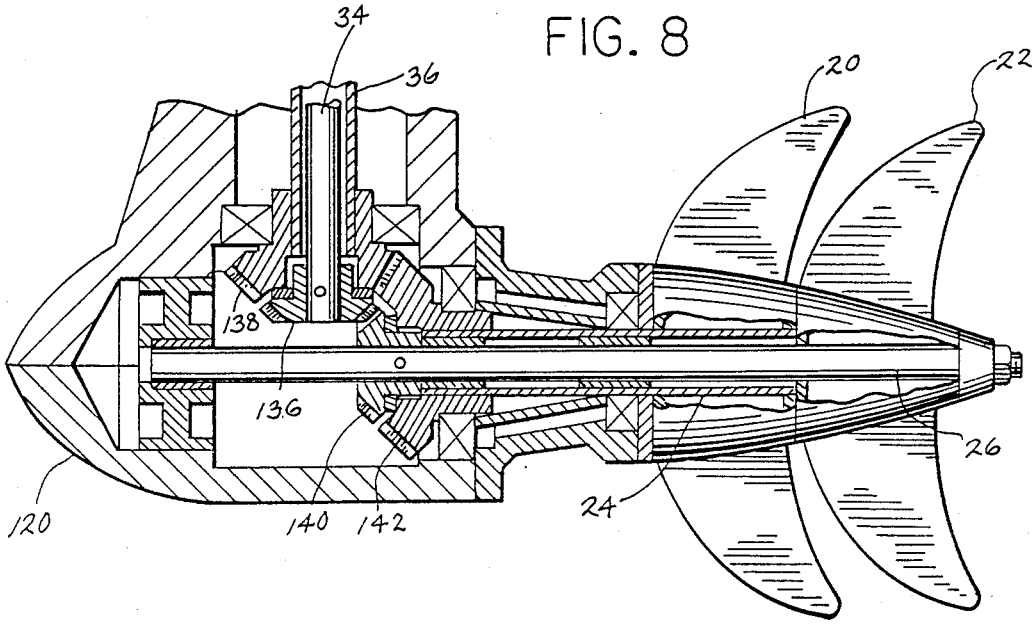

GEAR DRIVEN MARINE PROPULSION SYSTEM WITH STEERABLE GEARCASE AND DUAL COUNTERROTATING PROPELLERS

BACKGROUND AND SUMMARY

This invention relates to a marine propulsion system, and more particularly to such a system employing counterrotating propellers.

It has been found that employing a single propeller in a marine propulsion system results in imbalanced propeller torque leading to hydrodynamic inefficiencies. For example, the torque load from the rotating propeller must be overcome during steering when pivoting the system about its substantially vertical steering axis. Utilization of dual counterrotating propellers substantially reduces or eliminates such inefficiencies.

The present invention discloses a marine propulsion system utilizing dual counterrotating propellers, and a drive system including shafts and gears for driving the propellers. Reference is made to copending application Ser. No. 07/242,357 filed Sept. 9, 1988 and entitled Chain Drive Marine Propulsion System With Dual Counterrotating Propellers. This application discloses a counterrotating propeller system, with the propellers driven by a chain driving mechanism. In accordance with the present invention, a dual counterrotating propeller system is driven by a gear and shaft arrangement, which facilitates a steerable gearcase construction. As will be explained, the drive system of the invention provides highly satisfactory steering through the steerable portion of the gearcase by substantially eliminating torque loads which result from employment of a single propeller driven by a shaft and gear system. First and second concentric propeller shafts are rotatably mounted in the lower portion of a depending gearcase. The propeller shafts are preferably coaxially mounted one within the other. A first propeller is mounted to the first propeller shaft, and a second propeller is mounted to the second propeller shaft. Rotatable shaft means extends longitudinally through the gearcase, and is interconnected with the engine output shaft so as to be rotatable in response to rotation thereof. Gear means is interposed between the shaft means and the first and second propeller shafts for providing counterrotation of the first and second propeller shafts, and thereby of the first and second propellers.

In one embodiment, the shaft means comprises inner and outer concentric and coaxial shafts, interconnected with the engine output shaft so as to be rotatable in response to rotation thereof. Counterrotation means is included in the system for providing counterrotation of the inner and outer shafts. The gear means preferably comprises a first driving gear connected to one of the longitudinally extending coaxial shafts, and second driving gear means connected to the other of such shafts. Each propeller shaft is preferably provided with a driven gear engageable with one of the driving gears. The driving and driven gears are arranged so that counterrotation of the inner and outer coaxial longitudinal shafts is transferred to the coaxial propeller shafts, to provide counterrotation of the propellers. With this construction, the counterrotation of the driving gears provides cancelling gear torque loads when steering the lower steerable portion of the gearcase about a steering axis defined by the axis of the inner and outer longitudinal shafts. Likewise, the counterrotation of the propellers also provides cancelling propeller torque loads, thus easing steering about the steering axis.

Satisfactory steering means is provided for effecting pivoting movement of the lower steerable portion of the gearcase about the steering axis. In one embodiment, the steering means may comprise a rack and pinion arrangement mounted to the upper portion of the gearcase and acting on a rotatable projecting portion of the lower steerable gearcase portion for pivoting the steerable portion of the gearcase about the steering axis.

The drive system of the invention is satisfactorily employed in either an outboard configuration or an inboard/outboard stern drive system, as will be explained.

BRIEF DESCRIPTION OF THE DRAWINGS

The drawings illustrate the best mode presently contemplated of carrying out the invention.

In the drawings:

FIG. 6 is a partial elevation view, with portions broken away, showing an inboard/outboard arrangement for the drive system of the invention;

FIG. 7 is a partial plan view showing the upper drive portion of the structure shown in FIG. 6; and FIG. 8 is a detailed elevation view, partially in section and with portions broken away, showing the lower portion of the drive system of FIG. 6.

DETAILED DESCRIPTION OF THE PREFERRED EMBODIMENT

Figure 1:
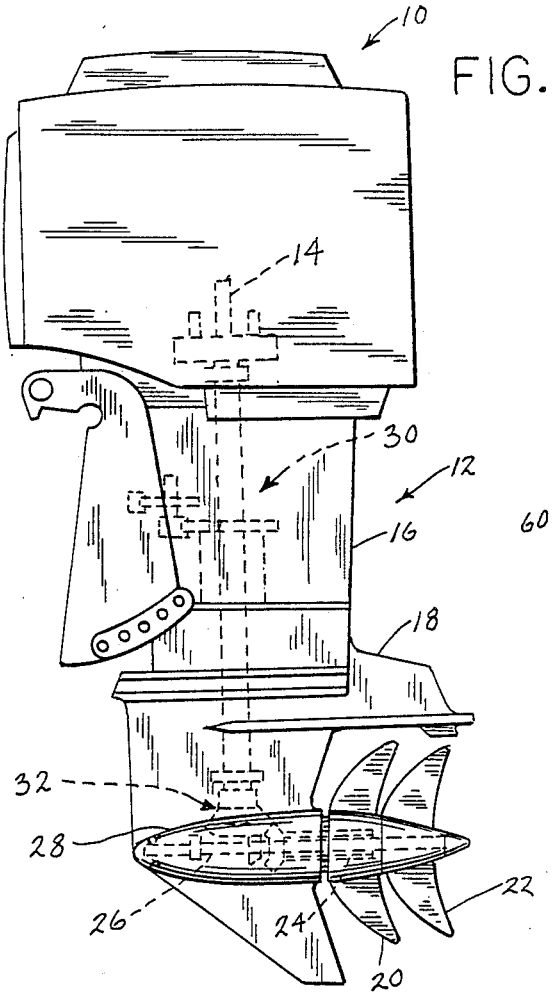
FIG. 1 is a side elevation view of an outboard marine propulsion system incorporating the dual counterrotating propeller and drive arrangement of the invention.

With reference to FIG. 1, an outboard marine propulsion system includes a power head 10 and a depending gearcase 12. As is known, power head 10 includes an internal combustion engine having a rotatable output shaft, shown at 14. In this configuration, the longitudinal axis of the engine is typically oriented vertically, and output shaft 14 is disposed parallel thereto.

Gearcase 12 generally includes an upper portion 16 and a lower steerable portion 18. A pair of propellers 20, 22 are mounted to a pair of coaxial propeller shafts, shown at 24, 26, respectively, rotatably mounted within a torpedo 28 formed in the lower end of steerable gearcase portion 18.

Axially extending shaft means, shown generally at 30, extends longitudinally through gearcase 12. Shaft means 30 is interconnected with propeller shafts 24, 26 by gear means, shown generally at 32, to provide counterrotation of propeller shafts 24, 26, as will be explained.

Figure 2:
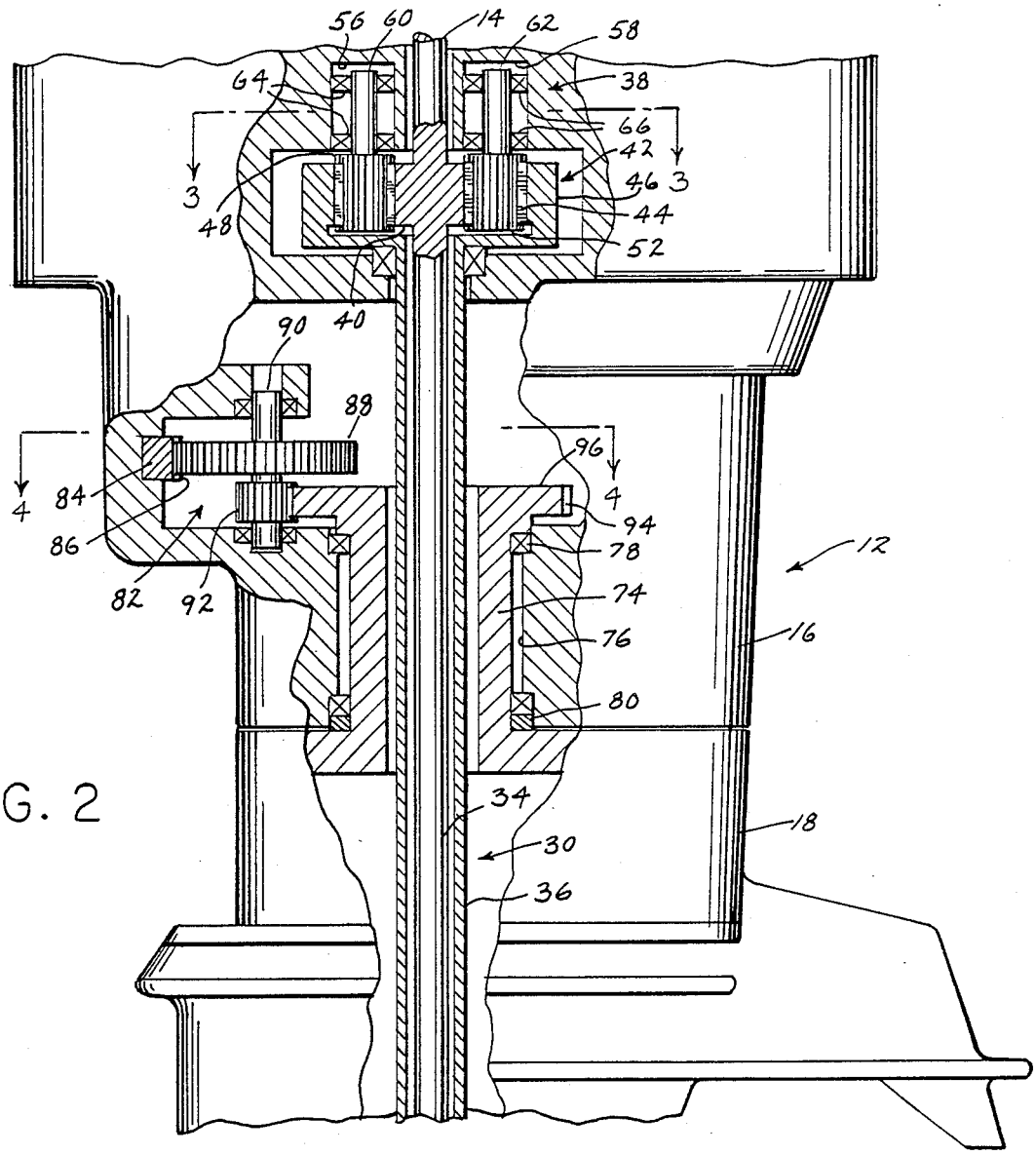
FIG. 2 is an enlarged partial elevation view, with portions broken away, showing the drie system of FIG. 1.

With reference to FIG. 2, shaft means 30 generally includes an inner shaft 34 and an outer shaft 36. As is shown, inner shaft 34 is disposed within the interior of outer shaft 36, which is hollow in cross section. Inner and outer shafts 34, 36 are arranged so as to be substantially coaxial. Inner and outer shafts 34, 36 are adapted to be driven in opposite rotational directions so that, through gear means 32, counterrotation is provided to propeller shafts 24, 26.

Figure 3:
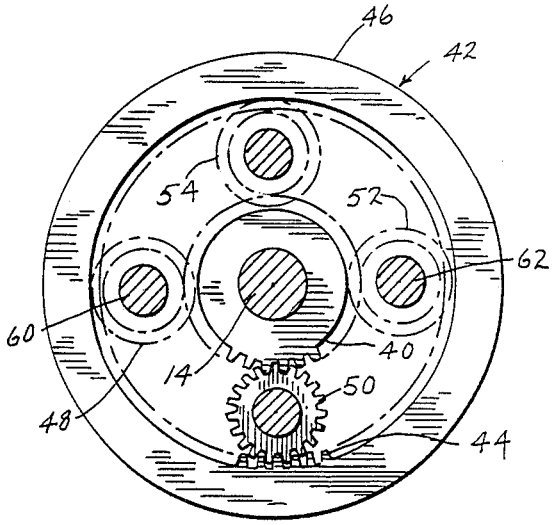
FIG. 3 is a partial sectional view taken generally along lines 3—3 of FIG. 2.

As a means for providing counterrotation of inner and outer shafts 34, 36, a counterrotation drive means, shown generally at 38, is interposed between engine output shaft 14 and inner and outer shafts 34, 36. Counterrotation drive means 38 includes an inner counterrotation drive gear 40 drivingly connected to output shaft 14, and a counterrotation driven gear 42, connected at the upper end of outer shaft 36. As shown, counterrotation driven gear 42 is a cup-like member, having a series of inwardly extending teeth 44 formed about the inner periphery of an upstanding wall 46. A series of idler gears, shown at 48, 50, 52 and 54 (see FIG. 3) are disposed between outer teeth formed on counterrotation drive gear 40 and teeth 44 provided on counterrotation driven gear 42. With reference to FIG. 2, idler gears 48–54 are rotatably mounted within a series of recesses, shown at 56, 58, formed in upper portion 16 of gearcase 12. Each idler gear is provided with an upstanding pin, shown at 60, 62 (FIG. 2) rotatably mounted within recesses 56, 58, respectively, by means of bearing assemblies 64, 66. With this construction, rotation of output shaft 14 results in rotation of inner shaft 34 in the same rotational direction, while such rotation of output shaft 14 is transferred through counterrotation drive gear 40, idler gears 48–54 and counterrotation driven gear 42 to outer shaft 36. Counterrotation of inner and outer shafts 34, 36 is thus provided.

Figure 5:
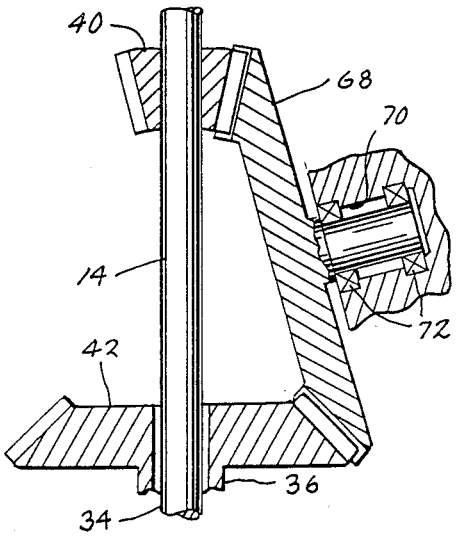
FIG. 5 is a partial elevation view showing an alternate embodiment for imparting counterrotation to the longitudinally extending coaxial shafts.

FIG. 5 illustrates an alternate embodiment for providing counterrotation of inner and outer shafts 34, 36. In this embodiment, counterrotation drive gear 40 is in the form of a bevel gear fixed to output shaft 14, while counterrotation driven gear 42 is in the form of a bevel gear fixed to the upper end of outer shaft 36. An idler bevel gear 68 is engageable with counterrotation drive gear 40 and counterrotation driven gear 42, and is rotatably supported within a recess 70 formed in upper gearcase portion 16 by means of bearings 72. Like the construction detailed above, this construction provides counterrotation of inner and outer shafts 34, 36, while providing a wide range of available gear ratios between counterrotation drive gear 40 and counterrotation driven gear 42.

Figure 4:
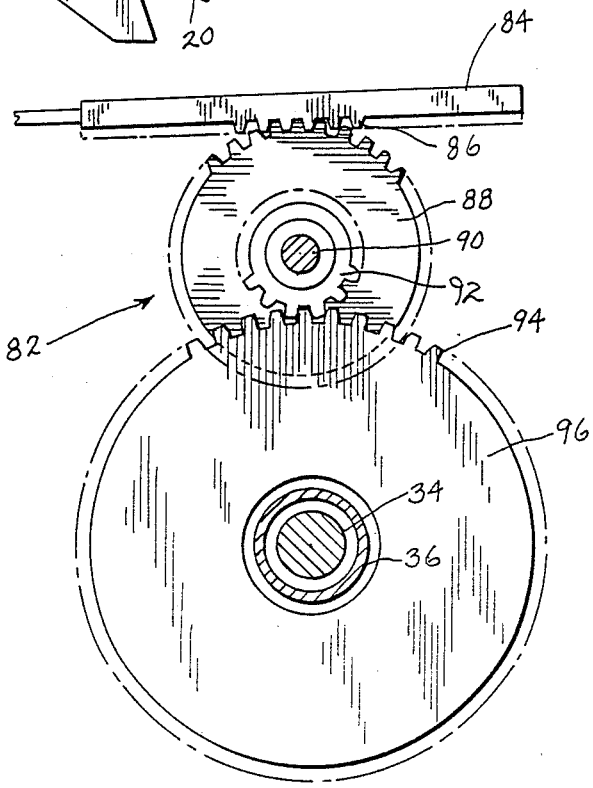
FIG. 4 is a partial sectional view taken generally along lines 4—4 of FIG. 2.

As noted previously, gearcase 12 includes a steerable lower portion 18 which is pivotable about an axis defined by the longitudinal axis of inner and outer shafts 34, 36 relative to gearcase upper portion 16. With further reference to FIG. 2, the mechanism for providing such steering generally includes an upstanding projecting portion 74 connected to steerable gearcase portion 18, and pivotably mounted within an opening 76 formed in upper gearcase portion 16 by means of upper and lower bearings 78, 80, respectively. A steering drive mechanism, shown generally at 82, is mounted within upper gearcase portion 16 for effecting pivoting movement of projecting portion 74 about the steering axis defined by inner and outer shafts 34, 36. Referring to FIGS. 2 and 4, steering mechanism 82 includes a longitudinally movable rack 84 having a series of teeth 86 and engageable with a gear 88. Gear 88 is rotatably mounted within upper gearcase portion 16 by means of a pin 90 rotatably supported therein. A pinion 92 is also mounted to pin 90, so as to be rotatable in response to rotation thereof. The teeth of pinion 92 are engageable with a series of teeth 94 provided about the outer periphery of an outwardly extending lip 96 formed on upstanding projecting protion 74. In this manner, longitudinal back and forth movement of rack 84, in response to operator command, is transferred through rack teeth 86 and gear 88 to cause rotation of pin 90, which is transferred through steering pinion 92 and teeth 94 to upstanding projecting portion 74 and thereby to steerable gearcase portion 18.

Referring to FIG. 6, an inboard/outboard stern drive arrangement of the invention is illustrated. Where possible, like reference characters will be used to facilitate clarity. In this embodiment an engine, shown generally at 100, is mounted in the interior of a boat 102 adjacent the boat transom 104. A depending drive unit 106 is mounted to the exterior of boat transom 104 by means of a mounting bracket 108. A chain drive mechanism, shown generally at 110, is disposed between engine 100 and drive unit 106 for transferring power from engine 100 to drive unit 106. As with the embodiment of FIG. 1, the embodiment of FIG. 6 provides a steerable lower drive unit portion 112 and an upper drive unit portion 114. Propellers 20, 22 are fixed to a pair of concentric propeller shafts rotatably mounted within a torpedo 120, formed at the lower end of steerable drive unit portion 112. Any satisfactory means may be employed to effect steering of steerable drive unit portion 112 by pivoting portion 112 about a substantially vertical steering axis relative to upper gearcase protion 114.

With reference to FIG. 7, engine 100 includes a rotatable crankshaft (not shown) interconnected with a universal joint, shown generally at 122. Universal joint 122 is connected at its leftward end to a rotatable output shaft 124, which has a sprocket 126 fixed thereto. A chain 128 is provided about sprocket 126 and about a sprocket 130 fixed to an input shaft 132 provided at the upper end of drive unit 106. An input bevel gear 134 is fixed to the rightward end of input shaft 132.

Reference is now made to FIG. 8, which details the drive components disposed in the lower portion of steerable portion 112 of drive unit 106. While FIG. 8 illustrates such components in connection with the embodiment of FIG. 6, it is understood that a substantially identical gearing arrangement is employed with respect to the embodiment of FIG. 1. Accordingly, where possible to facilitate clarity, like reference characters will be utilized in describing the components of FIG. 8 as were employed in the foregoing description of the embodiment of FIG. 1.

As shown, inner drive shaft 34 is provided at its lower end with a drive gear 136, and outer drive shaft 36 is provided at its lower end with a drive gear 138. Inner and outer drive shafts 34, 36 extend upwardly within upper gearcase portion 114 and are drivingly connected with input bevel gear 134. Outer drive shaft 36 has a bevel gear fixed to its upper end and engageable with input bevel gear 134 at its lower end, while inner drive shaft 34 has a bevel gear fixed to its upper end and engageable with input bevel gear 134 at its upper end. This construction provides rotation of inner and outer shafts 34, 36 in opposite directions, resulting in counterrotation of drive gears 136, 138. Outer propeller shaft 24 has a driven gear 142 fixed to its inner end, and driven gear 142 is engageable with drive gear 138. Likewise, inner propeller shaft 26 has a driven gear 140 fixed to its inner end, and driven gear 140 is engageable with drive gear 136. In this manner, counterrotation of shafts 34, 36 is transferred through gears 136–142 to provide counterrotation of propeller shafts 24, 26.

While not shown in the drawings, a satisfactory reversing transmission of conventional construction can be employed to provide forward or reverse boat operation by controlling the direction of rotation of propellers 20, 22.

In either of the above-described embodiments, the steerable lower gearcase portion is pivotable about a steering axis defined by the longitudinal axis of drive shafts 34, 36. With the provision of counterrotating gears 136, 138 at the lower end of shafts 34, 36, respectively, and the counterrotation of such gears, the torque loads resulting from rotation of gears 136, 138 about the steering axis substantially cancel each other out during operation. Accordingly, steering of the lower steerable gearcase portion is more easily accomplished about the steering axis. Likewise, the torque loads resulting from rotation of the propellers are substantially cancelling, so that little, if any, propeller torque must be overcome in order to effect steering.

Various alternatives and modifications are contemplated as being within the scope of the following claims particularly pointing out and distinctly claiming the subject matter regarded as the invention.

I claim:

1. In a marine drive for a boat, said marine drive including an engine having a rotatable output shaft and a depending gearcase, the improvement comprising:

a first propeller shaft rotatably mounted to said depending gearcase;

a second propeller shaft rotatably mounted to said depending gearcase, said firsst and second propeller shafts being disposed one within the other, and being substantially coaxial;

a first propeller mounted to said first propeller shaft;

a second propeller mounted to said second propeller shaft;

a pair of coaxial shafts extending longitudinally through said gearcase, and said coaxial shafts being interconnected with said engine output shaft so as to be rotatable in response to rotation thereof, wherein the inner one of said coaxial shafts is connected directly to said output shaft so as to rotate in the same direction as said output shaft;

counterrotation means for driving said pair of axially extending shafts in opposite rotational directions in response to rotation of said output shaft, said counterrotation means being disposed between said output shaft and the outer one of said coaxial shafts for rotating said outer coaxial shaft in a direction opposite that of said inner coaxial shaft; and gear means interposed between said first and second propeller shafts and said pair of coaxial shafts for providing counterrotation of said first and second propeller shafts, and thereby said first and second propellers, in response to rotation of said pair of coaxial shafts, said gear means comprising:

a first driven gear fixed to the inner one of said propeller shafts;

a second driven gear fixed to the outer one of said propeller shafts;

a first drive gear fixed to the inner one of said pair of coaxial shafts and engageable with said first driven gear; and a second drive gear fixed to the outer one of said pair of coaxail shafts and engageable with said second driven gear;

so that said first and second driven gears are driven in opposite rotational directions.

2. The improvement according to claim 1, wherein said counterrotation means comprises counterrotation gear means interposed between said engine output shaft and said outer shaft for providing rotation of said outer shaft in a direction opposite that of said output shaft.

3. The improvement according to claim 2, wherein said counterrotation gear means comprises:

a counterrotation drive gear rotatable in response to rotation of said output shaft;

a counterrotation driven gear fixed to said outer shaft; and one or more idler gears disposed between said counterrotation drive gear and said counterrotation driven gear for providing rotation of said driven gear in a rotational direction opposite that of said drive gear, thereby providing counterrotation of said inner and outer shafts.

4. The improvement according to claim 3, wherein said counterrotation driven gear comprises a cup-like gear member connected to said outer shaft and having a series of inwardly extending gear teeth disposed about the inner periphery of a wall of said cup-like gear member, and wherein said counterrotation drive gear is disposed within said cup-like driven gear and said one or more idler gears are disposed between said counterrotation drive gear and said inwardly extending gear teeth of said cup-like driven gear.

5. The improvement according to claim 3, wherein said counterrotation drive gear comprises a bevel gear rotatable in response to rotation of said output shaft, and wherein said counterrotation driven gear comprises a bevel gear fixed to said outer shaft, and wherein said idler gear comprises a bevel gear drivingly engageable with said drive bevel gear and said driven bevel gear.

6. The improvement according to claim 1, wherein said depending gearcase includes a steerable lower portion to which said first and second propeller shafts are rotatably mounted, and further comprising steering means for providing pivoting movement of said steerable lower portion of said gearcase, said steerable lower portion being steerable about a longitudinal steering axis defined by the axis of said coaxial shafts extending longitudinally thrugh said gearcase, wherein the counterrotation of said first and second drive gears provides cancelling gear torque about said steering axis, and the counterrotation of said first and second propellers provides cancelling propeller torque for improving ease of steering of said steerable lower portion of said gearcase.

7. The improvement according to claim 6, wherein said steering means comprises an upwardly projecting portion interconnected with said steerable lower portion of said gearcase and pivotably mounted to the upper portion of said gearcase so as to be pivotable about said longitudinal steering axis, and means for effecting pivoting movement of said projecting portion about said steering axis for pivoting said steerable lower portion of said gearcase about said steering axis.

8. The improvement according to claim 7, wherein said means for effecting pivoting movement of said projecting portion comprises rack and pinion means mounted in the upper portion of said gearcase for pivoting said projecting portion about said steering axis in response to operator command.

* * * * *

UNITED STATES PATENT AND TRADEMARK OFFICE

CERTIFICATE OF CORRECTION

PATENT NO. : 4,887,982

DATED : December 19, 1989

INVENTOR(S) : Neil A. Newman and Herbert A. Bankstahl

It is certified that error appears in the above-identified patent and that said Letters Patent is hereby corrected as shown below:

Col. 5, Line 31, Claim 1, delete "firsst" and substitute therefor --- first ---

Col. 5, Line 65, Claim 1, delete "coaxail" and substitute therefor --- coaxial ---

Col. 6, Line 45, Claim 6, delete "thrugh" and substitute therefor --- through ---

Signed and Sealed this

Seventh Day of May, 1991

*Attest:*

*Attesting Officer*

HARRY F. MANBECK, JR.

*Commissioner of Patents and Trademarks*